US011136973B2

(12) United States Patent
Van Stell

(10) Patent No.: US 11,136,973 B2
(45) Date of Patent: Oct. 5, 2021

(54) TUBING RETENTION MECHANISM USABLE WITH A PERISTALTIC PUMP

(71) Applicant: Cole-Parmer Instrument Company LLC, Vernon Hills, IL (US)

(72) Inventor: James Van Stell, Schaumburg, IL (US)

(73) Assignee: COLE-PARMER INSTRUMENT COMPANY LLC, Vernon Hills, IL (US)

( * ) Notice: Subject to any disclaimer, the term of this patent is extended or adjusted under 35 U.S.C. 154(b) by 113 days.

(21) Appl. No.: 16/517,434

(22) Filed: Jul. 19, 2019

(65) Prior Publication Data

US 2020/0025190 A1 Jan. 23, 2020

Related U.S. Application Data

(60) Provisional application No. 62/701,279, filed on Jul. 20, 2018.

(51) Int. Cl.
*F04B 43/12* (2006.01)
*F04B 53/16* (2006.01)

(52) U.S. Cl.
CPC ..... *F04B 43/12* (2013.01); *F04B 53/16* (2013.01); *F05C 2203/02* (2013.01); *F05C 2225/04* (2013.01)

(58) Field of Classification Search
CPC ..... F04B 43/12; F04B 53/16; F05C 2203/02; F05C 225/04

(Continued)

(56) References Cited

U.S. PATENT DOCUMENTS 4,095,923 A 6/1978 Cullis
4,886,431 A 12/1989 Soderquist et al.

(Continued)

FOREIGN PATENT DOCUMENTS

DE 8801774 U1 5/1988
GB 1067529 A 5/1967

(Continued)

OTHER PUBLICATIONS

Extended European Search Report issued by the European Patent Office in corresponding Application No. 19187244.9, dated Nov. 28, 2019.

(Continued)

*Primary Examiner* — Connor J Tremarche
(74) *Attorney, Agent, or Firm* — Arent Fox LLP

(57) ABSTRACT

An apparatus, method, and system for retaining tubing used in a peristaltic pump. The apparatus includes tubing retention device usable with a peristaltic pump, the tubing retention device including a movable tubing retainer having a tubing engaging portion capable of engaging with a first surface of a tube and a track portion for movably supporting the tubing retainer. At least one of the movable tubing retainer or the track portion has a surface formed of or at least partially coated with a friction reducing coating. The apparatus further comprises a second tubing engaging portion capable of engaging with a second surface of the tube and a biasing member biasing the movable tubing retainer towards the second tubing engagement portion. Engagement of the tubing retainer and the second tubing engaging portion reduces longitudinal movement of the tube.

20 Claims, 5 Drawing Sheets

(58) Field of Classification Search
USPC ..... 417/477.9
See application file for complete search history.

(56) References Cited

U.S. PATENT DOCUMENTS

| | | | | |
|---|---|---|---|---|
| 5,099,750 | A | 3/1992 | Rebel | |
| 5,380,173 | A * | 1/1995 | Hellstrom | F04B 43/1253 417/477.11 |
| 7,980,835 | B2 * | 7/2011 | LaBanco | F04B 43/1284 417/477.12 |
| 2005/0129545 | A1 | 6/2005 | Prosek, Jr. | |
| 2005/0196307 | A1 | 9/2005 | Limoges | |
| 2006/0095836 | A1 | 5/2006 | Ono et al. | |
| 2007/0138693 | A1 * | 6/2007 | Torii | B29C 45/14 264/242 |
| 2013/0315763 | A1 * | 11/2013 | Neoh | F04B 43/1284 417/474 |
| 2015/0368579 | A1 * | 12/2015 | Taki | C10M 103/04 396/532 |

FOREIGN PATENT DOCUMENTS

| | | | |
|---|---|---|---|
| GB | 1445731 | A | 8/1976 |
| KR | 101006479 | B1 | 1/2011 |
| WO | WO-2018093676 | A1 | 5/2018 |

OTHER PUBLICATIONS

European Office Action issued against corresponding European Application No. 19 187 244.9 dated Mar. 9, 2021.

* cited by examiner

TUBING RETENTION MECHANISM USABLE WITH A PERISTALTIC PUMP

CLAIM OF PRIORITY

This application claims priority to U.S. Provisional Application No. 62/701,279, titled "TUBING RETENTION MECHANISM USABLE WITH A PERISTALTIC PUMP," filed Jul. 20, 2018, which is assigned to the assignee hereof, and incorporated herein by reference in its entirety.

FIELD OF THE INVENTION

Aspects of the present disclosure relate to peristaltic pumps. More specifically, aspects of the present disclosure relate to a device, system, and method for retaining tubing used in a peristaltic pump.

BACKGROUND

Rotary peristaltic pumps are typically used for moving liquids through flexible tubing. A typical peristaltic pump has a rotor assembly with rollers that apply pressure to the flexible tubing at spaced locations to provide a squeezing action on the tubing against an occlusion bed. The occlusion of the tubing creates increased pressure ahead of the squeezed area and reduced pressure behind that area, thereby forcing a liquid through the tubing as the rotor assembly moves the rollers along the tubing. The flexible tubing used within the peristatic pump passes through the pump via a tubing exit and a tubing inlet. In order to create the occlusion of the tubing with the rollers, the tubing must also be held relatively stationary along an axial direction with relation to the occlusion bed. Accordingly, a tubing retention mechanism is generally employed to hold the tubing stationary along an axial direction. Since the tubing used within the peristaltic pump must eventually be replaced, there is a need for a tubing retention mechanism that holds the tubing sufficiently stationary along an axial direction with relation to the occlusion bed while improving ease of tubing replacement.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

Among other things, aspects of the present disclosure include a method, apparatus, and system for retaining tubing used in a peristaltic pump. The tubing retention device may include a movable tubing retainer having a tubing engaging portion capable of engaging with a first surface of a tube and a track portion for movably supporting the tubing retainer. At least one of the movable tubing retainer or the track portion has a surface with a reduced friction coefficient. The reduced friction coefficient may be achieved by forming the tubing retainer and/or track portion from a self-lubricating or low friction material and/or by coating the tubing retainer and/or track portion with a friction reducing coating. The apparatus further comprises a second tubing engaging portion capable of engaging with a second surface of the tube and a biasing member biasing the movable tubing retainer towards the second tubing engagement portion. Engagement of the tubing between the tubing retainer and the second tubing engaging portion reduces and/or prevents longitudinal movement of the tube.

In one aspect, a peristaltic pump is disclosed. The peristaltic pump includes a frame, and a rotor that is operatively connected to the frame and rotatable about a first axis. The rotor may include a plurality of rollers rotatably mounted to the rotor. The peristaltic pump may further include an occlusion bed having a surface facing at least one of the plurality of rotors, wherein the rotors and the occlusion bed are configured to apply pressure to tubing installed between the surface of the occlusion bed and the rotors. The pump may further include a tubing retention device having a movable tubing retainer with a tubing engaging portion capable of engaging with a first surface of a tube and a track portion for movably supporting the tubing retainer. At least one of the movable tubing retainer or the track portion has a surface with a reduced friction coefficient. The reduced friction coefficient may be achieved by forming the tubing retainer and/or track portion from a self-lubricating or low friction material and/or by coating the tubing retainer and/or track portion with a friction reducing coating. The apparatus further comprises a second tubing engaging portion capable of engaging with a second surface of the tube and a biasing member biasing the movable tubing retainer towards the second tubing engagement portion. Engagement of the tubing between the tubing retainer and the second tubing engaging portion reduces longitudinal movement of the tube.

BRIEF DESCRIPTION OF THE DRAWINGS

The novel features believed to be characteristic of aspects of the disclosure are set forth in the appended claims. In the description that follows, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objects and advantages thereof, will be best understood by reference to the following detailed description of illustrative aspects of the disclosure when read in conjunction with the accompanying drawings, wherein:

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details.

The foregoing description of various aspects and examples have been presented for purposes of illustration and description. It is not intended to be exhaustive nor to limit the disclosure to the forms described. The embodiment(s) illustrated in the figures can, in some instances, be understood to be shown to scale for illustrative purposes. Numerous modifications are possible in light of the above teachings, including a combination of the abovementioned aspects. Some of those modifications have been discussed and others will be understood by those skilled in the art. The various aspects were chosen and described in order to best illustrate the principles of the present disclosure and various aspects as are suited to the particular use contemplated. The scope of the present disclosure is, of course, not limited to the examples or aspects set forth herein, but can be employed in any number of applications and equivalent devices by those of ordinary skill in the art. Rather, it is hereby intended the scope be defined by the claims appended hereto.

A peristaltic pump usable with the current disclosure may include a rotor assembly with pinch rollers that apply pressure to flexible tubing at spaced locations to provide a squeezing action on the tubing against an occlusion bed. The occlusion or partial occlusion of the tubing creates increased pressure ahead of the squeezed area and reduced pressure behind the squeezed area, thereby forcing a fluid through the tubing as the rotor assembly moves the pinch rollers along the tubing causing occlusion. A single or plurality of flexible tubes may be used within the peristatic pump and may pass through the pump via a single or plurality of sets of tubing inlets and tubing exits. The tubing used in the peristaltic pump may be held substantially stationary along an axial direction with relation to the occlusion bed. Accordingly, a tubing retention mechanism may be employed to hold the tubing stationary along an axial direction. Further details of a peristaltic pump and/or retention mechanism are described with relation to the figures in further detail below.

Figure 1:
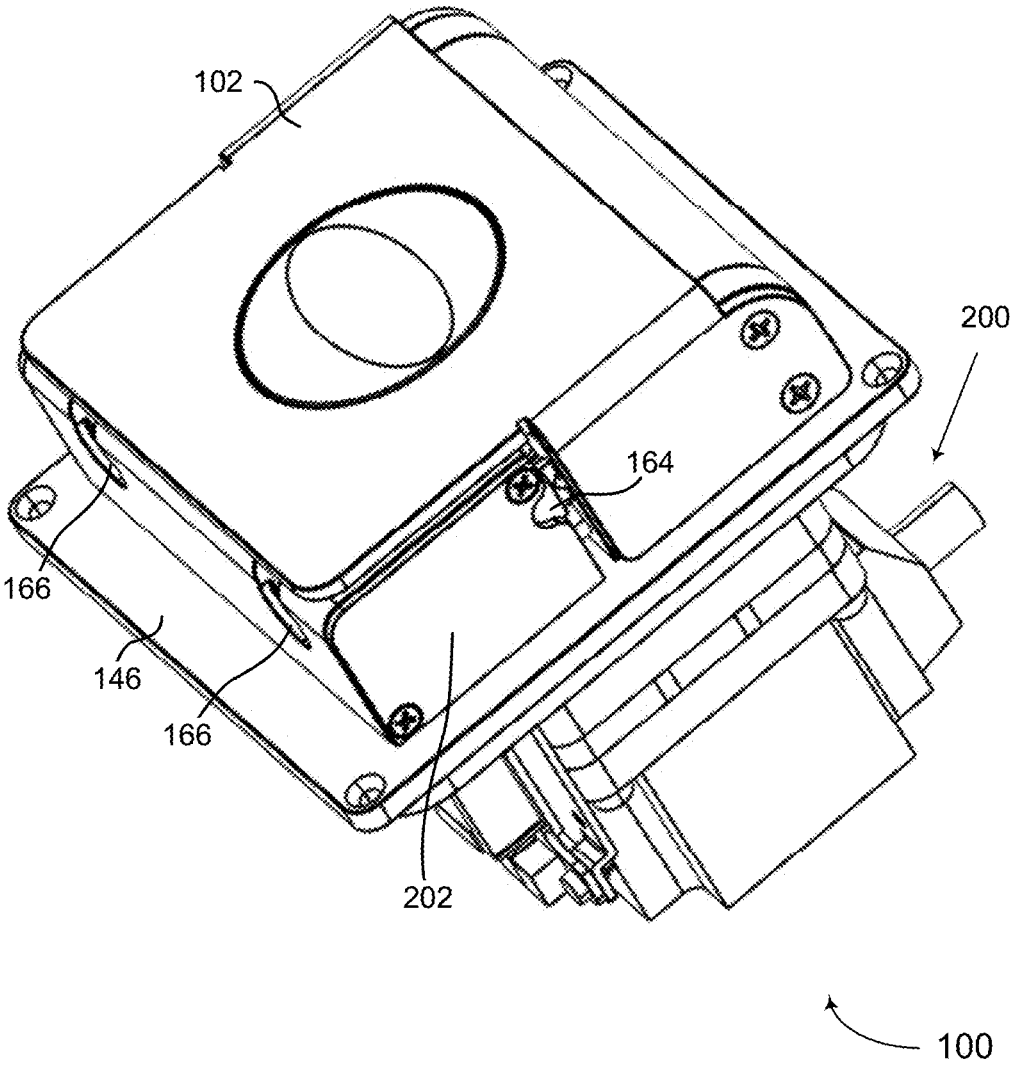
FIG. 1 is a perspective view of an example peristaltic pump in accordance with an aspect of the disclosure.

FIG. 1 shows one example of a peristaltic pump 100 usable with the current disclosure. The peristaltic pump 100 may include a frame or body with a mounting flange 146, and an outer cover 102 covering and/or partially covering the inner portion of the pump and/or the occlusion bed 120. The peristaltic pump may further include a first set of tubing inlet(s) and/or outlet(s) 164 (one of the first tubing inlet(s) and/or outlet(s) is hidden from view in FIG. 1), and a second set of tubing inlet(s) and/or outlet(s) 166. A tubing retention mechanism cover plate 202 may cover the tubing retention mechanism 250 when the peristaltic pump is fully assembled. The peristaltic pump 100 may further include a motor and/or transmission 200 and an outer housing for encasing the motor and/or transmission.

Figure 2:
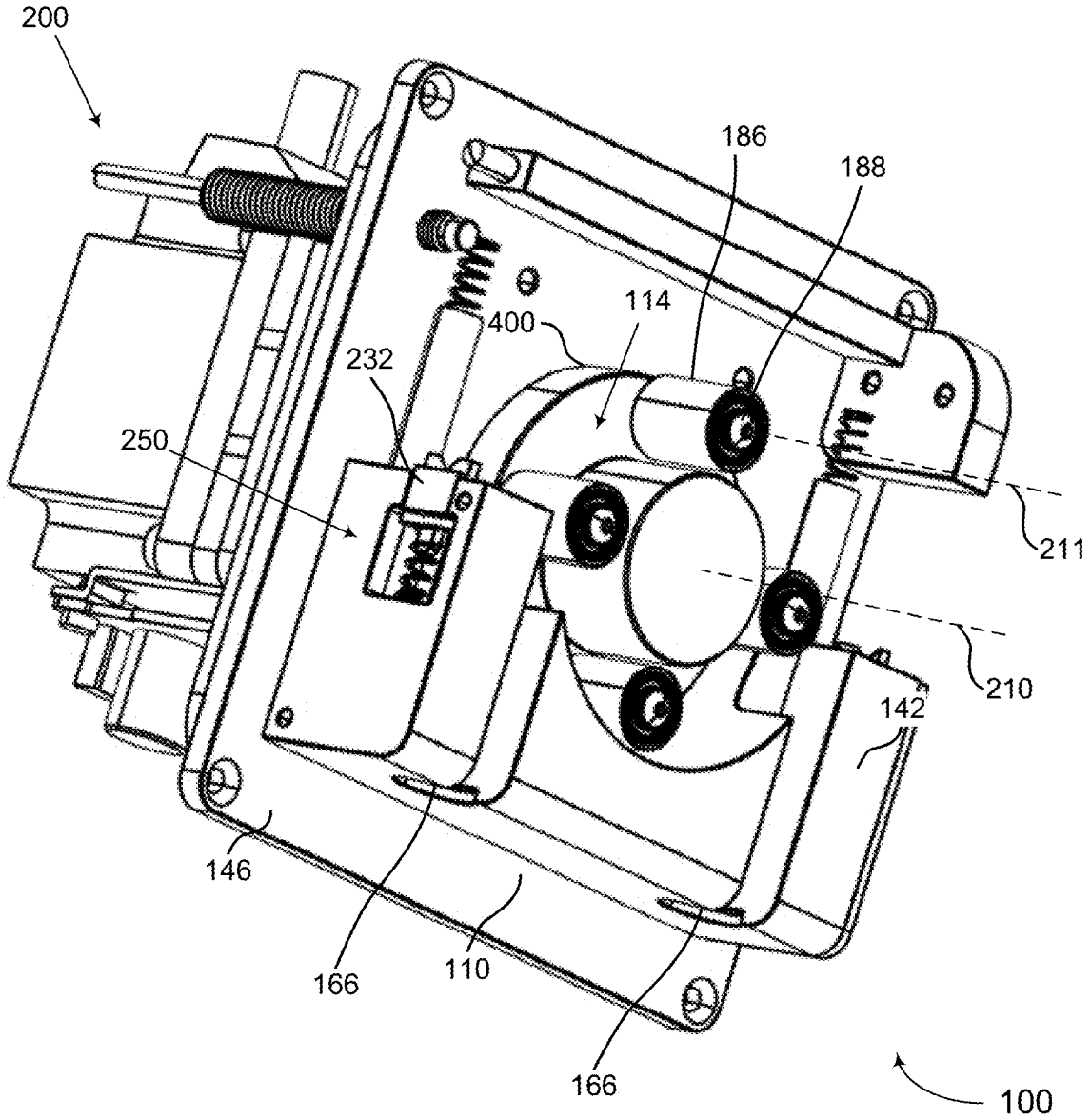
FIG. 2 is partial perspective view of the example peristaltic pump of FIG. 1 utilizing a tube retention mechanism in accordance with an aspect of the disclosure.

FIG. 2 shows the peristaltic pump 100 shown in FIG. 1, with the outer cover 102 and several other components including the tubing retention mechanism cover plate 202 removed. The pump 100 may include a rotor 114 that may be generally centrally located within the pump. The rotor 114 may extend through the frame and mounting flange 146 and may be driven by a motor and/or transmission 200 to rotate within the pump 100 about a rotor axis 210. The rotor 114 may include a plurality of rollers 186. Each roller 186 may be rotatably connected to shaft 188 so as to be rotatable about an axis 211 parallel with the rotor axis 210. In an aspect, the rotor 114 may also include a drive feature (not shown) engageable with the motor and/or transmission 200 and/or a seal 400 for isolating the pump from the motor and/or transmission 200. In an aspect, a portion of the rotor 114 may be viewable though window and/or opening portion 138 of the outer cover 102 (best shown in FIG. 4). The pump may include a tubing retention mechanism 250 at the first set of tubing inlet(s) and/or outlet(s) 164.

Figure 3:
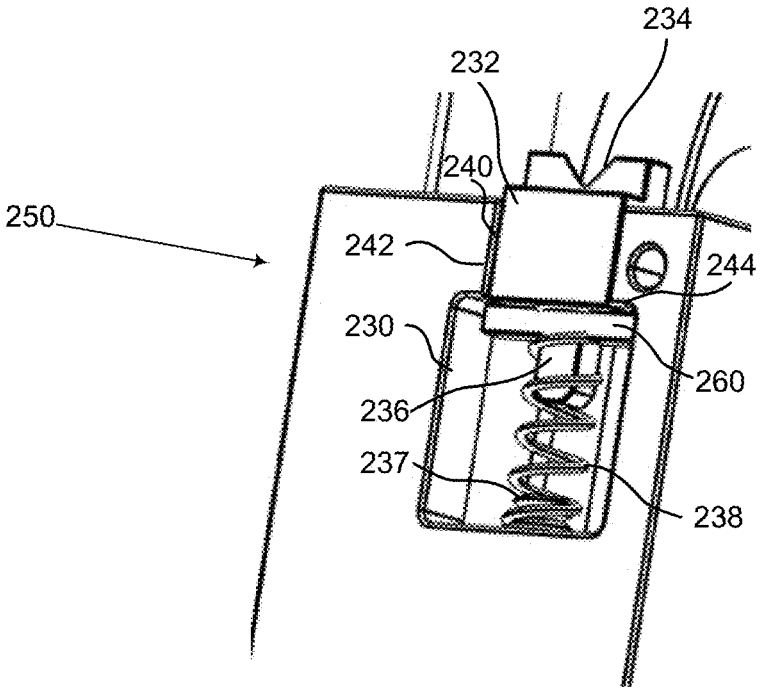
FIG. 3 is an enlarged partial perspective view of the tubing retention mechanism of FIGS. 1 and 2 in accordance with an aspect of the disclosure.

FIG. 3 shows a magnified view of one example of a tubing retention mechanism in accordance with one aspect of the disclosure. The tubing retention mechanism 250 of the peristaltic pump 100 may include a cavity 230. The cavity 230 may include a track portion 242 configured to slidably engage with a track receiving portion 240 of a tubing retainer 232. The cavity 230 of the tubing retention mechanism may further include a first biasing member receiving portion 237. The first biasing member receiving portion 237 may be a protrusion within the cavity 230 for receiving a biasing member 238. The protrusion forming the first biasing member receiving portion 237 may have a square or rectangular cross-section, for example. As another example, the first biasing member receiving portion 237 may also have an X-shaped cross section, circular or oval cross-section. As an alternative, the first biasing member receiving portion 237 may be a cavity having a circular or cross section otherwise dimensioned to receive a biasing member therewithin. As shown in FIG. 3, the track portion 242 can include a pair of opposing tracks configured to slidably engage with a track receiving portion 240 on opposite sides of the tubing retainer 232.

The tubing retainer 232 may include a tubing receiving notch 234 (herein interchangeably referred to as a tubing engaging portion). The tubing receiving notch 234 may be v-shaped or may be curved, square, rectangular, or any other shape suitable for providing a surface that is engageable with at least a first surface of a tube (e.g., tube 300 shown in FIG. 4). In an aspect, the shape of the tubing receiving notch 234 engages the tubing without substantially compressing an inner diameter of the tubing to reduce flow rate. The tubing retainer 232 may include track receiving portions 240 disposed on either side of the main body of the tubing retainer 232. The track receiving portion 240 may be configured to slidably engage with the pair of parallel track portions 242 of the cavity 230. The tubing retainer 232 may also include a second biasing member receiving portion 236. The second biasing member receiving portion may be shaped as a protrusion, having an outer geometry suitable for receiving one end of a biasing member 238. As shown in FIG. 3, the second biasing member receiving portion 236 may have a square or rectangular cross-section, for example. As another example, the second biasing member receiving portion 236 may also have an X-shaped cross section, circular or oval cross-section. The second biasing member receiving portion 236 may be configured to receive a biasing member 238. Some examples of biasing member 238 may include but are not limited to a coil spring, a flexible plastic or rubber tubular shaped member, a leaf spring, or any suitable flexible material for urging the main body of the tubing retainer 232 in an upward Y-direction as shown in FIG. 3 (e.g., toward the tubing inlet and/or outlet 164). The tubing retainer 232 may also include a stopper portion 260 that protrudes past the track receiving portions 240 and engages with a stopper receiving portion 244 of the cavity 230 when the tubing retainer slides to a designated distance in the upward Y-direction. Thus, contact between the stopper portion 260 and the stopper receiving portion 244 may prevent the biasing member 238 from urging the tubing retainer 232 too far in the upward Y-direction. Accordingly, contact between the stopper receiving portion 244 and the stopper portion may prevent the tubing retainer 232 from falling out of the track portion 242 of the tubing retention mechanism 250.

Figure 4:
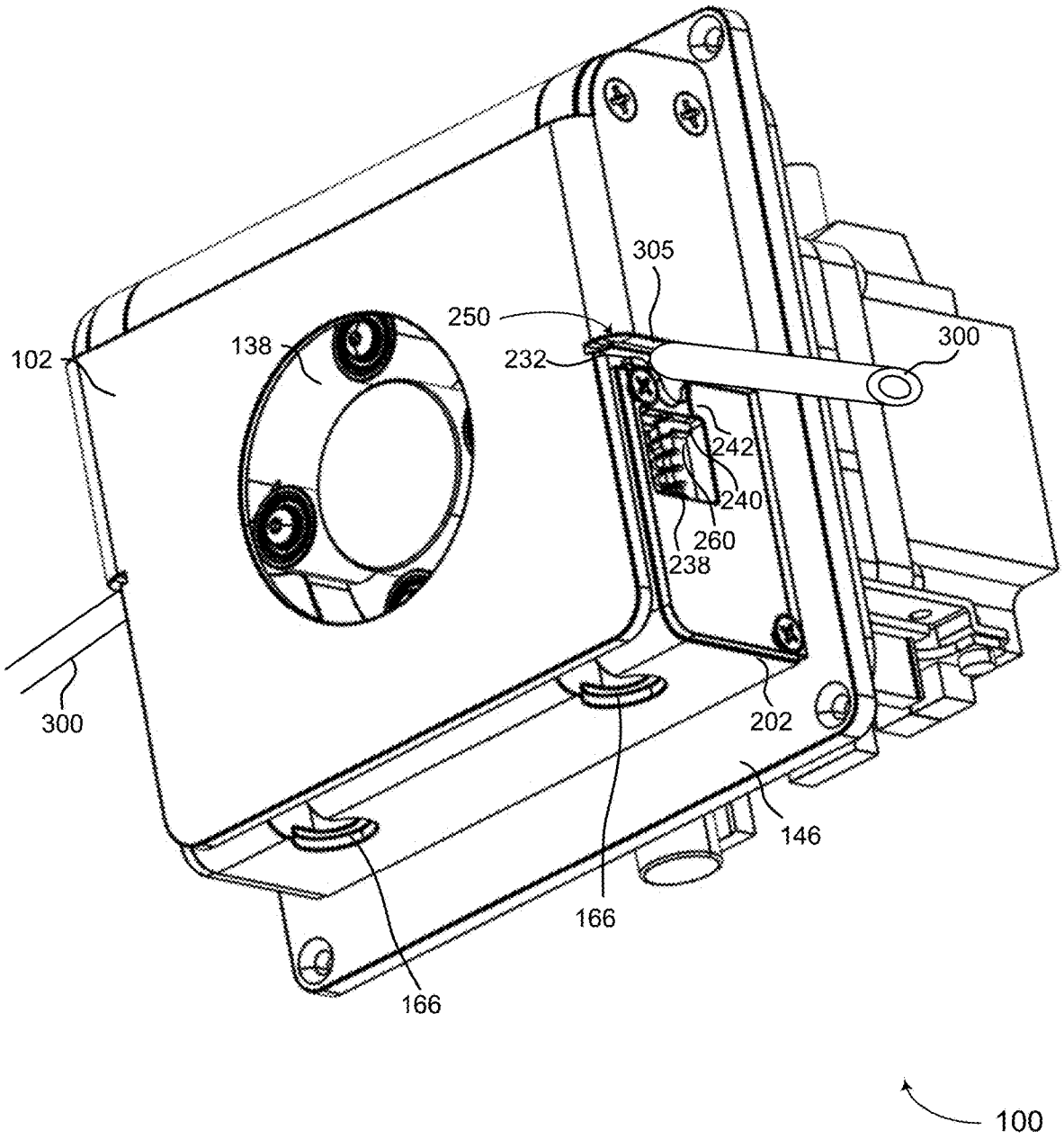
FIG. 4 is a partially semi-transparent perspective view of the peristaltic pump of FIGS. 1-3 with tubing installed in accordance with an aspect of the disclosure.
Figure 5:
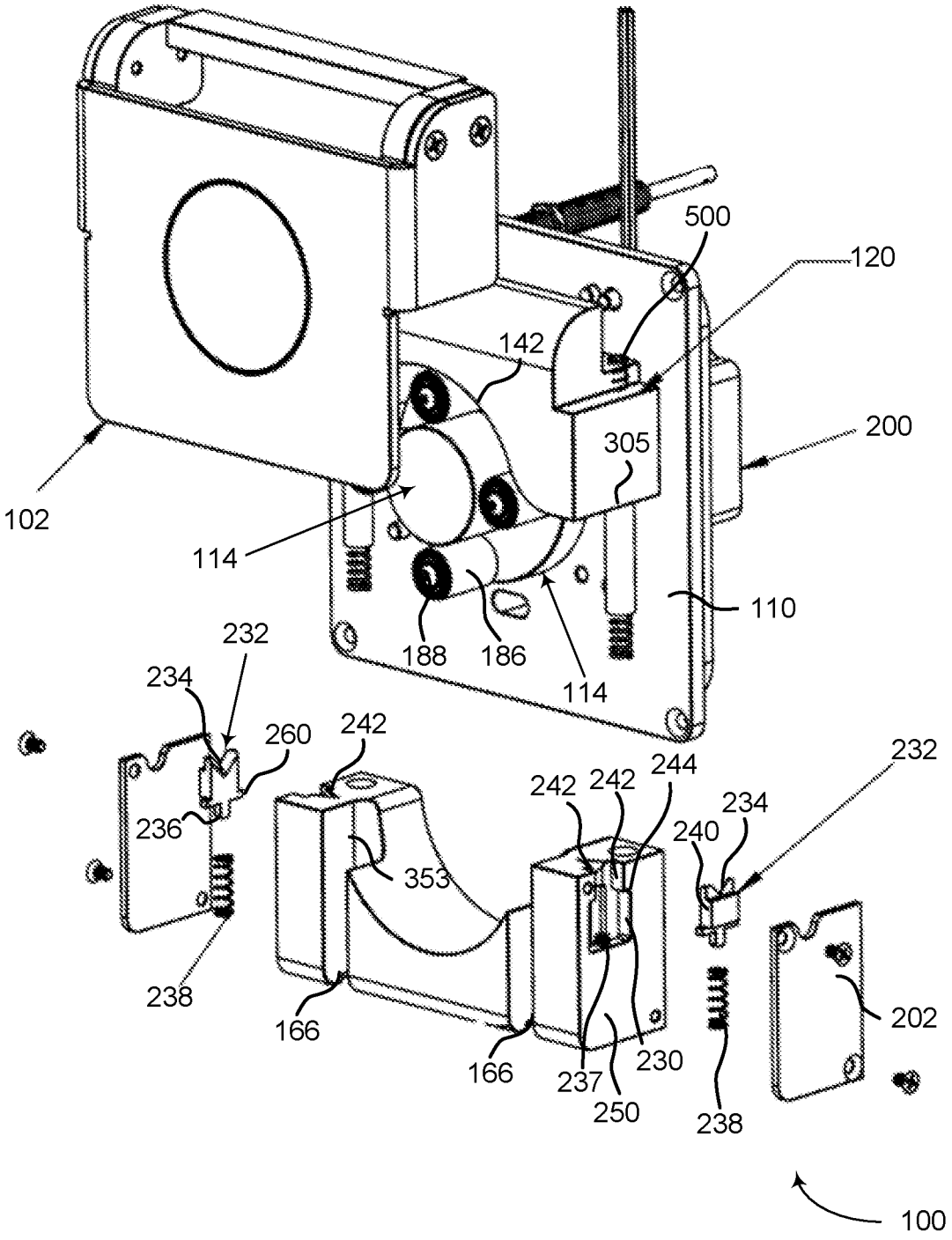
FIG. 5 is an exploded perspective view of an example peristaltic pump of FIGS. 1 and 2 utilizing a tube retention mechanism in accordance with an aspect of the disclosure.

While only a single tubing retention mechanism is discussed with relation to FIGS. 1-4, a similar or identical tubing retention mechanism may be disposed at an opposite end of the peristaltic pump 100 (e.g., as shown in FIG. 5). In one aspect the tubing retainer or both of the tubing retainers 232 may be coated with or formed of a material having a reduced friction coefficient such as a fluoropolymer. In accordance with one aspect of the disclosure, the tubing retainer(s) may be formed of a material containing an internal lubricant such as polytetrafluoroethylene (PTFE). In another example, the tubing retainer(s) may be formed of or coated with a polyphenylenesulfide (PPS) material with PTFE and glass fill. Further, the sliding surfaces of the track receiving portion 240 of the tubing retainer 232 may be coated with a lubricating material or coated with an anti-friction coating. The tubing retainer(s) may also be formed of polyoxymethylene (also known as acetal, polyacetal, or polyformaldehyde with trade names Delrin®, Celcon®, Ramtal®, Duracon®, Kepital®, and Hostaform®, for example), ultrahigh-molecular-weight polyethylene (UHMWPE) and/or a polyimide, polysulfone, polyphenylene sulfide, or any other suitable low-friction material. In another example, the tubing retention mechanism may be formed of a hardcoat or hard anodized aluminum or aluminum ahoy. Further, the aforementioned anodized aluminum or aluminum alloy may be sealed with PTFE or any of the anti-friction coatings discussed herein.

In another aspect, at least the sliding surfaces of the track receiving portion 240 of the tubing retainer(s) 232 may be formed of a self-lubricating metallic material. For example, the tubing retainer may be formed of bronze and/or bronze powder having a metallic backing material and/or a bronze with graphite lined material having a metallic backing. In another aspect a portion of and/or the entire surface of the tubing retainer may be sintered with a copper alloy containing uniformly dispersed solid lubricants, for example.

Similarly, either in combination with or as an alternative to the tubing retainer(s) 232 being formed of, coated with, and/or treated with the aforementioned low-friction treatments and/or materials. The track portion 242 of each tubing retention mechanism 250 may also be formed of, coated with, or treated using any of the aforementioned low friction materials and/or treatments discussed herein.

As shown in FIG. 5, the tubing retainer 232 may include a tubing receiving notch 234, and the tubing receiving notch 234 may providing a surface that is engageable with at least a first surface of a tube 300. The tubing retainer be slidably held in place by the parallel track portion 242, which may be engageable with track receiving portions 240 disposed on either side of the main body of the tubing retainer 232. In one aspect, an inner surface of the tubing retention cover plate 202 that faces the tubing retainer 232 or a portion of the cover plate 202 that faces the tubing retainer 232 may be coated with and/or treated using any of the aforementioned low friction treatments and/or coatings listed herein. In another aspect, the cover plate 202 may also be formed of any of the aforementioned low friction materials discussed herein.

As shown in FIGS. 4 and 5, when tubing 300 is installed in the peristaltic pump, the tubing retainer 232 may be biased to contact a first surface of the tubing via the tubing receiving notch 234. The peristaltic pump 100 may further include a second tubing engagement portion 305 capable of engaging with a second surface of a tube 300 when the tubing retainer 232 is biased towards tube 300 via biasing member 238. In one example, as shown in FIG. 5, the second tubing engagement portion 305 may be a portion of the occlusion bed 120. The occlusion bed 120 may be removably contained between the base 110 and the cover 102. In one aspect, the occlusion bed 120 may be slidably held between the base 110 and the cover 102. The occlusion bed 120 may be biased toward the rotor 114 by a biasing member 500. While only a single biasing member is shown in FIG. 5, a similar or identical biasing member may be disposed on the opposite end of the occlusion bed 120, which is hidden from view by the cover 102 in FIG. 5. The biasing member(s) 500 may be configured to bias the occlusion bed towards the rotor 114 when the cover 102 and the base 110 are assembled (e.g., as shown in FIG. 1). Some examples of biasing member(s) 500 may include but are not limited to a coil spring, a flexible plastic or rubber tubular shaped member, a leaf spring, or any suitable flexible material for urging the occlusion bed 120 in a downward Y-direction as shown in FIG. 5. The occlusion bed 120 may include a curved occlusion surface 142. In operation, as the rotor 114 rotates, the rollers 186 may squeeze any tubing (e.g., 300 in FIG. 4) against the occlusion surface 142 to force fluid through the tubing in a peristaltic action. In another aspect, the occlusion bed 120 may be rigidly supported by the base 110 and the cover 102. In another aspect, an occlusion bracket (not shown) may be hingedly connected to a linkage assembly causing the occlusion bed to move away from and towards the rotor 114. One example of such an alternative is disclosed in U.S. patent application Ser. No. 15/198,729, filed on Jun. 30, 2016, published as U.S. Publication No. 2018/0003169, the entirety of which is incorporated by reference herein.

With reference to FIGS. 4 and 5, the peristaltic pump 100 may have one or more lengths of tubing 300 (FIG. 4) secured between a rotor 114 and an occlusion bed 120 such that rotation of the rotor 114 displaces fluid therethrough. The tubing 300 may pass through the tubing retention mechanisms 250 on either side of the pump 100. Tubing 300 may be secured between the tubing engaging portion or notch 234 of the tubing retainer 232 and the second tubing engagement portion 305, the biasing member 238 causing the tubing 300 to be pinched or held between the tubing receiving notch 234 and the second tubing engagement portion 305. The contact between the tubing 300 and the tubing engaging portion or notch 234 and the second tubing engagement portion of 305 of the tubing retention mechanism(s) located on either side of the pump 100 may prevent the axial movement of the tube 300 while the rollers 186 squeeze tubing 300 against the occlusion surface 142 to force fluid through the tubing.

This written description uses examples to disclose aspects of the invention, including the preferred embodiments, and also to enable any person skilled in the art to practice the aspects thereof, including making and using any devices or systems and performing any incorporated methods. The patentable scope of these aspects is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Aspects from the various embodiments described, as well as other known equivalents for each such aspect, can be mixed and matched by one of ordinary skill in the art to construct additional embodiments and techniques in accordance with principles of this application.

What is claimed is:

1. A tubing retention device usable with a peristaltic pump, the tubing retention device comprising:

a movable tubing retainer having a tubing engaging portion capable of engaging with a first surface of a tube and a track receiving portion;

a second tubing engaging portion capable of engaging with a second surface of the tube;

a track portion for movably supporting the tubing retainer, wherein the track portion is located within a cavity that defines a first surface that contacts the movable tubing retainer, the track portion comprising a pair of opposing tracks defining a second surface and a third surface configured to slidably engage opposite sides of the track receiving portion of the movable tubing retainer;

a cover plate that defines a fourth surface that faces the movable tubing retainer; and a biasing member biasing the movable tubing retainer towards the second tubing engagement portion, wherein engagement of the tubing retainer and the second tubing engaging portion reduces longitudinal movement of the tube, and wherein at least one of the track receiving portion of the movable tubing retainer or the track portion have a surface with a friction reducing coating.

2. The tubing retention device of claim 1, wherein said friction reducing coating is a fluoropolymer.

3. The tubing retention device of claim 1, wherein said friction reducing coating is polytetrafluoroethylene (PTFE).

4. The tubing retention device of claim 1, wherein both of the track portion and the track receiving portion of the tubing retainer have the surface with the friction reducing coating.

5. The tubing retention device of claim 1, wherein the track portion has the surface with the friction reducing coating.

6. The tubing retention device of claim 1, wherein the track receiving portion of the movable tubing retainer has the surface with the friction reducing coating.

7. The tubing retention device of claim 1, wherein the track receiving portion of the tubing retainer is coated with a polyphenylenesulfide (PPS) material with PTFE and glass fill.

8. The tubing retention device of claim 1, wherein the track portion is coated with a polyphenylenesulfide (PPS) material with PTFE and glass fill.

9. The tubing retention device of claim 1, wherein the movable tubing retainer is slideable within the track portion in a direction transverse to a longitudinal axis of the tubing.

10. The tubing retention device of claim 1, wherein the tubing retention device further comprises a cover plate configured to cover the movable tubing retainer and the track portion, wherein at least a portion of the cover plate facing the tubing retainer has a friction reducing coating.

11. The tubing retention device of claim 1, wherein the movable tubing retainer is formed of anodized aluminum or aluminum alloy and the friction reducing coating is PTFE.

12. A peristaltic pump comprising:

a frame;

a rotor that is operatively connected to the frame and rotatable about a first axis, the rotor comprising a plurality of rollers rotatably mounted to the rotor;

an occlusion bed having a surface facing at least one of the plurality of rollers, wherein the rollers and the occlusion bed are configured to apply pressure to tubing installed between the surface of the occlusion bed and the rollers; and a tubing retention device, wherein the tubing retention device comprises:

a movable tubing retainer having a tubing engaging portion capable of engaging with a first surface of a tube and a track receiving portion;

a second tubing engaging portion capable of engaging with a second surface of the tube;

a track portion for movably supporting the tubing retainer, wherein the track portion is located within a cavity that defines a first surface that contacts the movable tubing retainer, the track portion comprising a pair of opposing tracks defining a second surface and a third surface configured to slidably engage opposite sides of the track receiving portion of the movable tubing retainer;

a cover plate that defines a fourth surface that faces the movable tubing retainer; and a biasing member biasing the movable tubing retainer towards the second tubing engagement portion, wherein engagement of the tubing retainer and the second tubing engaging portion reduces longitudinal movement of the tube, and wherein at least one of the track receiving portion of the movable tubing retainer or the track portion have a surface with a friction reducing coating.

13. The peristaltic pump of claim 12, wherein said friction reducing coating is a fluoropolymer.

14. The peristaltic pump of claim 12, wherein said friction reducing coating is polytetrafluoroethylene (PTFE).

15. The peristaltic pump of claim 12, wherein both of the track portion and the track receiving portion of the tubing retainer have a surface with the friction reducing coating.

16. The peristaltic pump of claim 12, wherein the track portion has the friction reducing coating.

17. The peristaltic pump of claim 12, wherein the track receiving portion of the movable tubing retainer has the friction reducing coating.

18. The peristaltic pump of claim 12, wherein the track receiving portion of the tubing retainer is coated with a polyphenylenesulfide (PPS) material with PTFE and glass fill.

19. The peristaltic pump of claim 12, wherein the track portion is coated with a polyphenylenesulfide (PPS) material with PTFE and glass fill.

20. The peristaltic pump of claim 12, wherein the movable tubing retainer is formed of anodized aluminum or aluminum alloy and the friction reducing coating is PTFE.

* * * * *